US005884533A

United States Patent [19]

Shyu et al.

[11] Patent Number: 5,884,533

[45] Date of Patent: Mar. 23, 1999

[54] DEVICE FOR HOLDING AND CONTROLLING THE OPENING ANGLE OF A DOOR

[75] Inventors: Song-Gen Shyu, Chia-Yi Hsien; Wen-Liang Huang, Taichunh, both of Taiwan

[73] Assignee: Tong Lung Metal Industry Co., Ltd., Taiwan

[21] Appl. No.: 865,402

[22] Filed: May 29, 1997

[30] Foreign Application Priority Data

Jun. 11, 1996 [TW] Taiwan ..... 85208871

[51] Int. Cl.[6] ..... G05G 5/06

[52] U.S. Cl. ..... 74/527; 74/528; 74/530; 74/475

[58] Field of Search ..... 74/527, 528, 526, 74/475, 489

[56] References Cited

U.S. PATENT DOCUMENTS

| | | | |
|---|---|---|---|
| 594,946 | 12/1897 | Grossman | 74/528 |
| 2,899,841 | 8/1959 | Melloy | 74/548 |
| 3,204,734 | 9/1965 | McMaken | 192/3 |
| 3,525,272 | 8/1970 | Olson | 74/530 |
| 5,213,004 | 5/1993 | Hoblingre | 74/528 |
| 5,319,992 | 6/1994 | Shui-Te | 74/543 |
| 5,461,937 | 10/1995 | Cymbal | 74/493 |
| 5,606,893 | 3/1997 | Shifflett | 74/527 |
| 5,622,083 | 4/1997 | Kirimoto et al. | 74/475 |

*Primary Examiner*—Vinh T. Luong
*Attorney, Agent, or Firm*—Ladas & Parry

[57] ABSTRACT

A device for holding and adjusting the opening angle of a door includes a first lever having a forked end with two generally parallel lugs which are respectively provided with substantially aligned first and second pivot holes, and a second lever which has a journal member for insertion into the first pivot hole, the journal member having a threaded hole and a first engagement surface. A first detent member is inserted between the parallel lugs and has a pivot slot aligned with the first and second pivot holes. The first detent member further includes a second engagement surface for engagement with the first engagement surface, and a detent face. A resilient second detent member is mounted inside the first lever inwardly of the forked end to engage the detent face.

2 Claims, 4 Drawing Sheets

DEVICE FOR HOLDING AND CONTROLLING THE OPENING ANGLE OF A DOOR

BACKGROUND OF THE INVENTION

1. Field of the Invention

This invention relates to a device for holding a door and particularly to a door holding device capable of controlling and adjusting the opening angle of a door.

2. Description of the Related Art

It is known in the art to provide a door holder which incorporates means for controlling and adjusting the opening angle of a door. A typical construction of such a door holder is shown in FIG. 1 and comprises two operating levers for connection with a door frame and a door, respectively. One of the levers is pivotally connected to a support (A) adapted to be mounted on the door. The support (A) holds a gear member (B) which engages a spring-loaded rack (C) and which can stop the door when the gear member (B) engages each end of the rack (C). The construction as such does not allow the door to be so adjusted that it can stop at a desired angle relative to the door frame after it has been opened.

FIG. 2 shows another door holder which comprises two levers one of which has a spring-loaded detent member (D) to engage a detent plate (E) mounted in the forked end (J) thereof. The detent plate (E) in turn engages a toothed wheel (F) which is mounted on a post (G) of another lever. The toothed wheel (F) which engages both of the toothed face (H) formed around the post (G) and the detent plate (E) rotates when the door connected thereto is turned. When the detent plate (E) engages the spring-loaded detent member (D), the door is stopped. The angle at which the door is opened can be adjusted by loosening the locking screw of the door holder and turning and opening the door to an angle where the door has to stop. The construction as such permits the door to be immobilized at any desirable opening angle.

SUMMARY OF THE INVENTION

It is an object of the invention to provide a door control device that has a simple construction while permitting the opening angle of a door to be adjusted at any desired position.

The object of the invention can be achieved through the provision of a device for holding and controlling the turning movement of a door, which comprises first and second levers for connection with a door and a door frame, respectively. The first lever has a forked end with two generally parallel lugs which are provided with substantially aligned first and second pivot holes, respectively. The second lever has one end provided with a journal member for insertion into the first pivot hole, the journal member having a threaded hole and a first engagement surface. A first detent member is inserted between the parallel lugs and has a pivot slot aligned with the first and second pivot holes. The first detent member further includes a second engagement surface for engagement with the first engagement surface, and a detent face. A second detent member is resiliently mounted inside the first lever inwardly of the forked end to engage the detent face.

In a preferred embodiment of the invention, the first engagement surface has a plurality of first teeth which extend radially around the threaded hole of the journal member. The second engagement surface has a plurality of second teeth which extend radially around the pivot slot of the first detent member. The locking screw has a head, a screw portion to be threaded into the threaded hole, and a cylindrical portion which is formed between the head and the screw portion. The cylindrical portion has a diameter greater than that of the screw portion and is received in the second pivot hole of the first lever.

The present exemplary preferred embodiment will be described in detail with respect to the accompanying drawings.

DETAILED DESCRIPTION OF THE PREFERRED EMBODIMENT

Figure 1:
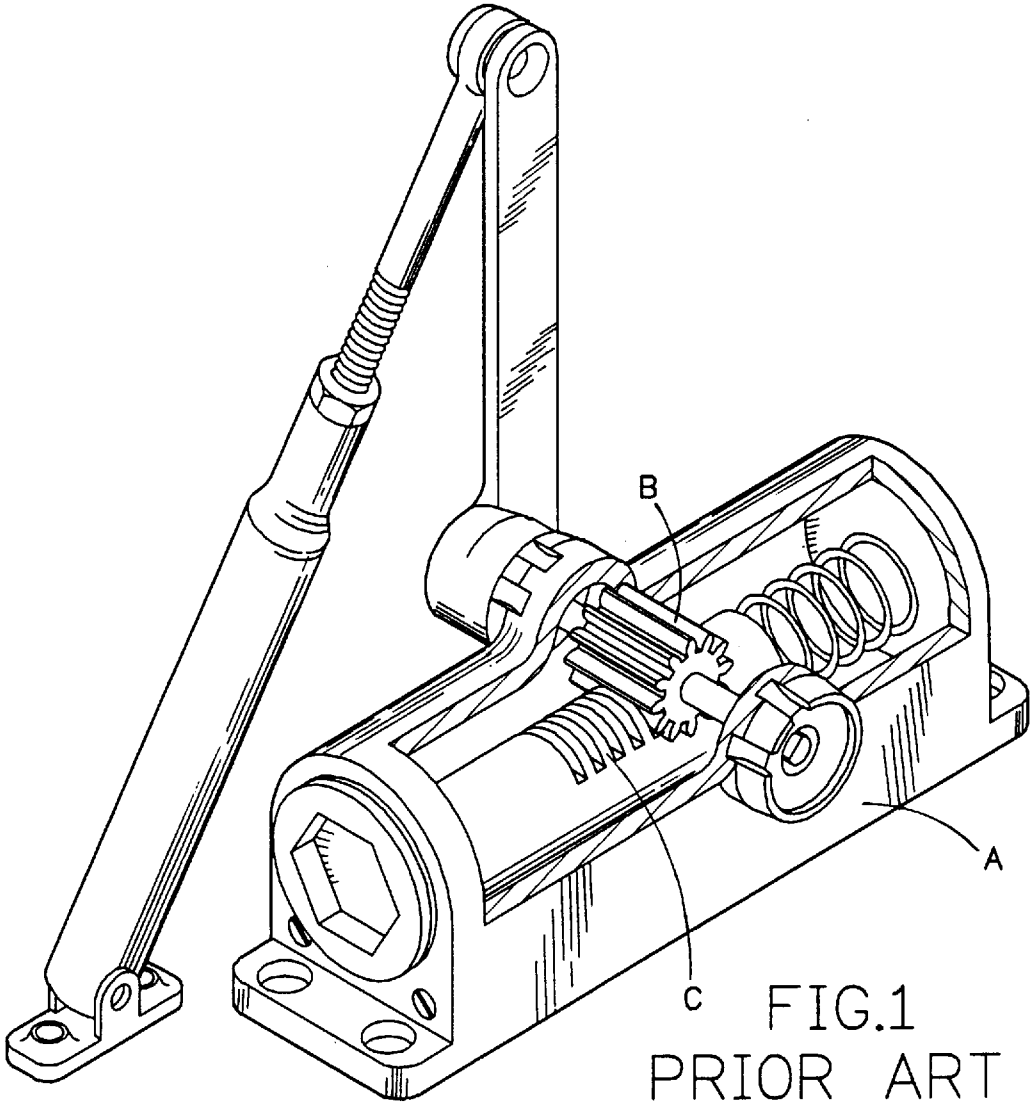
FIG.1 PRIOR ART
FIG. 1 shows a conventional door control device.
Figure 2:
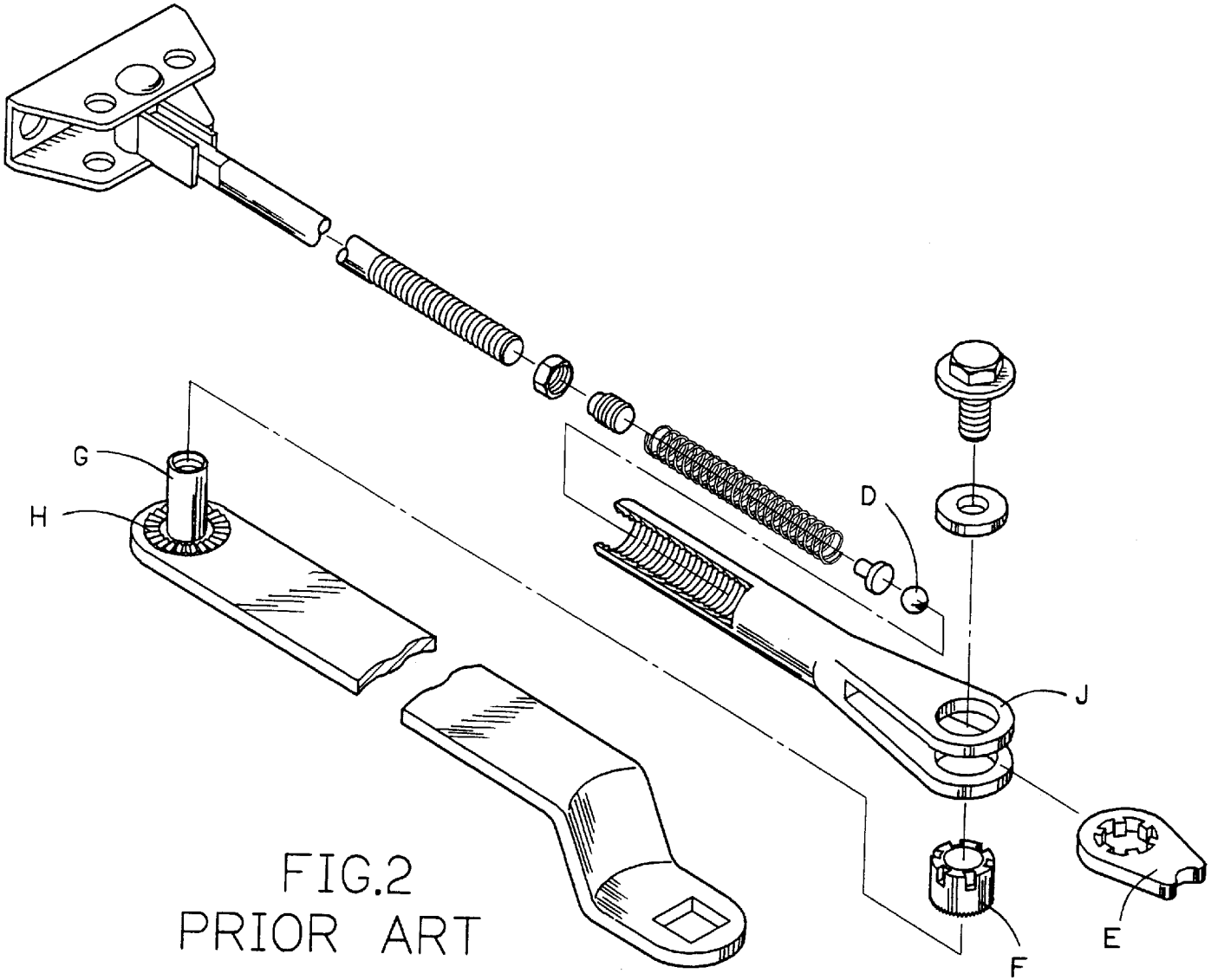
FIG.2 PRIOR ART
FIG. 2 shows another conventional door control device.
Figure 3:
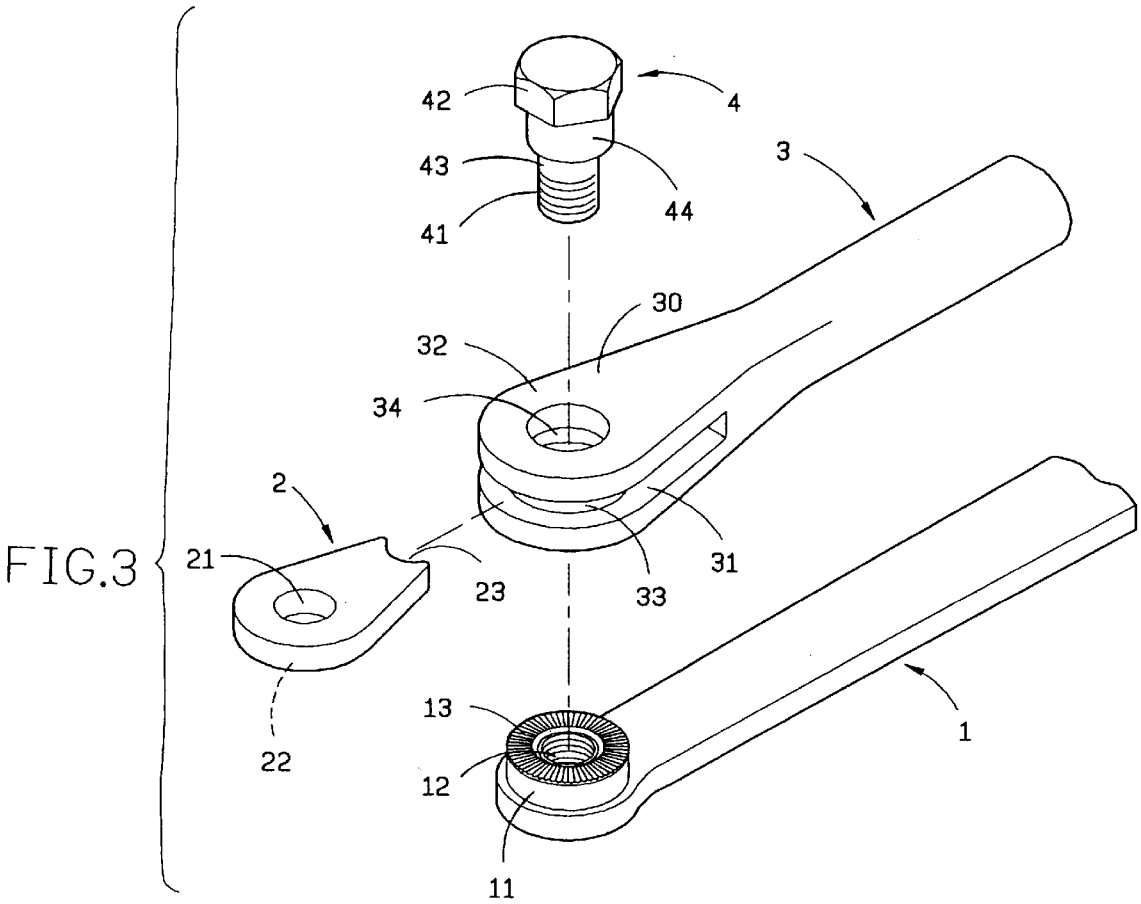
FIG. 3 shows an exploded view of a preferred embodiment of the present invention.
Figure 4:
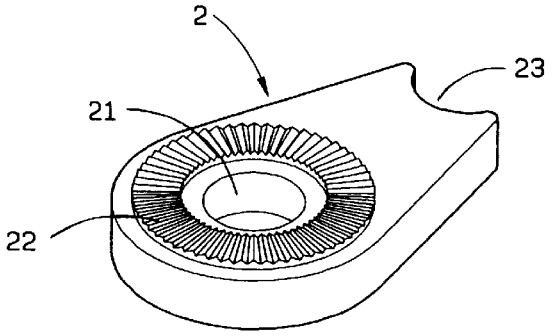
FIG. 4 is a perspective view of the first detent member used in the preferred embodiment.
Figure 5:
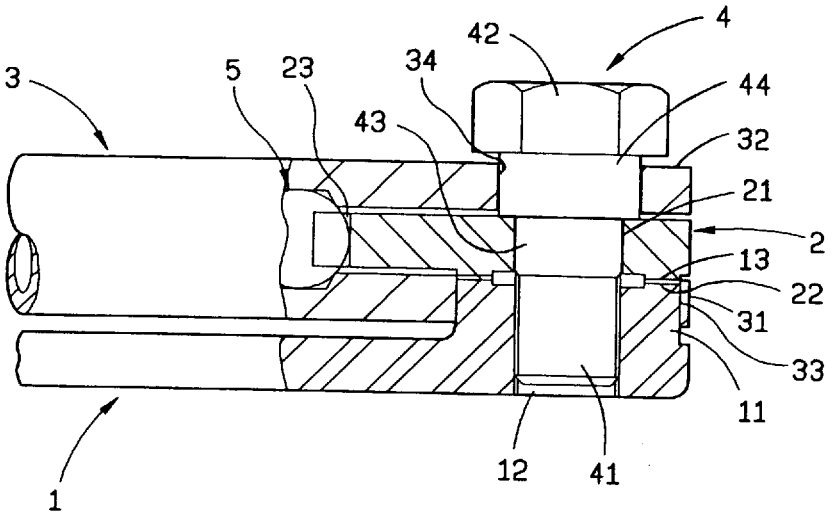
FIG. 5 is a sectional view showing the preferred embodiment.
Figure 6:
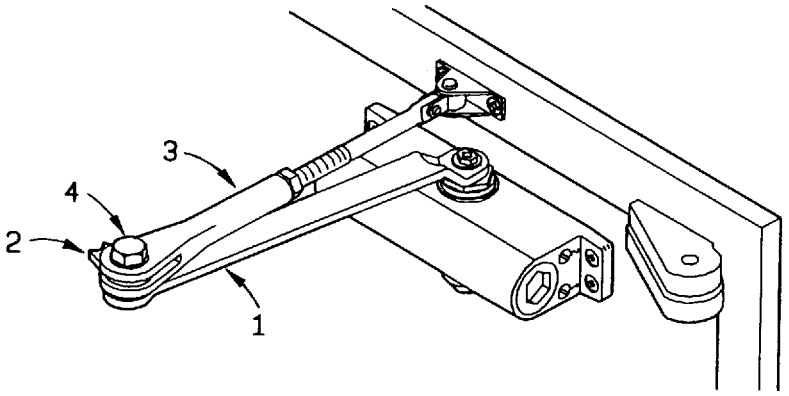
FIG. 6 shows the preferred embodiment in use.

Referring to FIGS. 3 to 6, a preferred embodiment of the device for holding and controlling the turning movement of a door according to the present invention comprises two levers 1 and 3 which are adapted to be mounted respectively on a door and a door frame. The lever 3 has a forked end 30 with two generally parallel planar lugs 31 and 32 which are provided with substantially aligned first and second pivot holes 33 and 34, respectively. The lever 1 has one end formed with a journal member 11 for insertion into the first pivot hole 33. The journal member has a threaded hole 12 and a plurality of first teeth 13 radially extending around the threaded hole 12.

A first detent member 2 is inserted between the parallel planar lugs 31 and 32 and has a pivot slot 21 aligned with the first and second pivot holes 33 and 34. The first detent member 2 further includes a plurality of radially extending second teeth 22 around the pivot slot 21 for engagement with the first teeth 13. A concave detent face 23 is formed at one side of the periphery thereof.

A second detent member 5 is resiliently mounted inside the lever 3 inwardly of the forked end 30 to engage the concave detent face 23. The construction of the second detent member 5 is conventional and has a spring-loaded ball.

A locking screw 4 has a head 42 and is inserted through the forked end 30, the first detent member 2 and the journal member 11. The locking screw 4 further has a screw portion 41 and first and second cylindrical portions 43 and 44 which are formed between the screw portion 41 and the head 42. The second cylindrical portion 44 has a cross-section greater than that of the screw portion 41 and the first cylindrical portion 43. The screw portion 41 is threaded into the journal member 11, and the cylindrical portions 44 and 43 are received in the second pivot hole 34 and the pivot slot 21, respectively.

When the locking screw 4 is tightened, the radially extending first and second teeth 13 and 22 engage each other. In operation, the rotation of the lever 1 upon turning and opening of the door will result in rotation of the locking screw 4 and turning of the first detent member 2 relative to the first lever 3. The concave detent face 23 of the first detent member 2 engages the second detent member 5 when the door is turned to an adjusted angle. When the door is closed, the concave detent face 23 pushes the second detent member 5 against the biasing action thereof and moves past the second detent member 5.

When it is desired to re-adjust the opening angle of the door, the locking screw 4 is first loosened to disengage the first and second teeth 13 and 22 from one another, and the first detent member 2 is placed in its engaging position with the second detent member 5. Then, the door is turned to the desired angle. In this situation, since the first and second teeth 13 and 22 disengage from one another, the first detent member 2 does not turn while the door is turned. When the door reaches the desired angle, the locking screw 4 is tightened once again while the first detent member 2 is in its engaging position with the second detent member 5.

With the invention thus explained, it is apparent that various modifications and variations can be made without departing from the spirit of the invention. It is therefore intended that the invention be limited only as claimed in the appending claims.

What I claim is:

1. A device for holding and controlling turning movement of a door comprising:

a first lever having a forked end, said forked end having two spaced lugs which are respectively provided with substantially aligned first and second pivot holes;

a second lever having one end which has a journal member for insertion into said first pivot hole, said journal member having a threaded hole and a first engagement surface;

a first detent member inserted between said parallel lugs and having a pivot slot aligned with said first and second pivot holes, said first detent member further including a second engagement surface for engagement with said first engagement surface, and a detent face;

a second detent member which is resiliently mounted inside in said first lever inwardly of said forked end to engage said detent face; and a locking screw which has a head, a screw portion to be threaded into said threaded hole, and first and second cylindrical portions which are formed between said head and said screw portion to be received in said pivot slot and said second pivot hole, respectively, said second cylindrical portion having a diameter greater than that of said first cylindrical portion and said screw portion.

2. The device as claimed in claim 1, wherein said first engagement surface has a plurality of first teeth which extend radially around said threaded hole of said journal member, said second engagement surface having a plurality of second teeth which extend radially around said pivot slot.

* * * * *